US007804025B2

(12) United States Patent
Terlizzi

(10) Patent No.: US 7,804,025 B2
(45) Date of Patent: Sep. 28, 2010

(54) COMPACT MAGNETIC CABLE NOISE SUPPRESSOR

(75) Inventor: Jeffrey J. Terlizzi, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 726 days.

(21) Appl. No.: 11/784,366

(22) Filed: Apr. 6, 2007

(65) Prior Publication Data

US 2008/0246576 A1 Oct. 9, 2008

(51) Int. Cl.
*H01B 11/06* (2006.01)

(52) U.S. Cl. ..... 174/36; 174/92

(58) Field of Classification Search ..... 174/36, 174/92; 336/92, 175, 176
See application file for complete search history.

(56) References Cited

U.S. PATENT DOCUMENTS

| | | | | |
|---|---|---|---|---|
| 5,262,591 | A | 11/1993 | Aldissi | |
| 5,476,394 | A * | 12/1995 | Sugihara et al. | 439/620.03 |
| 6,142,829 | A | 11/2000 | O'Groske et al. | |
| 6,534,708 | B2 | 3/2003 | Ono et al. | |
| 6,621,397 | B2 * | 9/2003 | Hsu | 336/96 |
| 6,840,817 | B2 | 1/2005 | Chen | |
| 6,972,097 | B2 | 12/2005 | Yoshida et al. | |
| 2007/0252669 | A1 * | 11/2007 | Hansen et al. | 336/212 |
| 2008/0012673 | A1 * | 1/2008 | Burkhardt et al. | 336/15 |

OTHER PUBLICATIONS

"Cable Shielding", application note of Philips Magnetic Products (Feb. 1997) 27 pages.
"Selecting and Using EMI Components and Materials" [online] Conformity (c) 2007 [retrieved on Apr. 6, 2007] <URL: www.conformity.com/artman/publish/printer_66.shtml>.

* cited by examiner

*Primary Examiner*—Chau N Nguyen
(74) *Attorney, Agent, or Firm*—Treyz Law Group; G. Victor Treyz; Nancy Y. Ru

(57) ABSTRACT

A compact magnetic cable noise suppressor may be provided for suppressing electromagnetic cable noise. The compact magnetic noise suppressor may be formed from a ferrite material or other magnetic material with a high permeability. The compact magnetic cable noise suppressor may be mounted within a chassis of a cable connector or may otherwise be attached to a cable. The magnetic cable noise suppressor may have portions that define a cable entrance, a cable exit, and a cable path. The cable path contains at least one bend. The cable path may contain multiple bends, may contain loops, may contain spirals, and may contain one or more vertically separated layers. The cable entrance and exit may be aligned or may be at different lateral or vertical positions. The cable entrance and exit may be on opposing sides of the noise suppressor or may be on adjacent sides of the noise suppressor.

14 Claims, 17 Drawing Sheets

COMPACT MAGNETIC CABLE NOISE SUPPRESSOR

BACKGROUND

This invention relates generally to electromagnetic noise suppression, and more particularly, to compact magnetic cable noise suppressors.

Cables are used to interconnect pieces of electronic equipment and to perform other signal routing duties. For example, cables that are compliant with the Digital Video Interface (DVI) standard are used to interconnect personal computers and computer monitors. Universal serial bus (USB) cables are commonly used to interconnect personal computers with peripherals such as music players, digital cameras, and printers.

Cables that carry high frequency signals may emit undesirable radio-frequency electromagnetic radiation. Cables may also be subject to radio-frequency noise from external sources. This is particularly the case in cables that do not use expensive high-quality coaxial termination arrangements. To minimize the impact of external radio-frequency noise sources and to reduce radio-frequency emissions, high-frequency cables are commonly shielded using conductive shielding such as braided copper, spiral windings of copper tape, spiral windings of thin copper wire, and metallized polymer. The conductive shielding serves to prevent external signals from coupling onto the signal wires in the cable and minimizes radio-frequency emissions from the cable that could adversely affect nearby electrical equipment.

Particularly when very high frequencies are involved (e.g., signals in the upper megahertz and lower gigahertz range), the use of conductive cable shielding is unable to eliminate all adverse radio-frequency effects. Moreover, in many arrangements the conductive shield of a cable is shorted to the ground of the electrical equipment to which it is connected. If the electrical equipment that is attached to the cable exhibits ground noise, the ground noise can be coupled onto the conductive shielding of the cable. Unless corrective measures are taken, the coupled ground noise can cause the conductive shielding to emit undesirable radio-frequency electromagnetic radiation.

Magnetic cable noise suppressors have been developed to address these problems. Magnetic cable noise suppressors are commonly based on toroidal ferrite beads or tubular ferrites. With this type of arrangement, a cable noise suppressor is placed at the end of a cable where it surrounds the signal wires in the cable. The noise suppressor attenuates radio-frequency noise by creating a large impedance at high electromagnetic frequencies.

Ferrite beads are typically mounted to the end of a cable in an exposed position. Adequate noise suppression often requires the use of ferrite beads that are large. Large ferrite beads that are mounted to the end of a cable are difficult to conceal and tend to be unsightly and cumbersome.

It would therefore be desirable to provide compact magnetic cable noise suppression devices.

SUMMARY

In accordance with the present invention, a compact magnetic cable noise suppressor may be provided that reduces electromagnetic cable noise while occupying a minimal amount of space. The compact magnetic cable noise suppressor may be formed from a ferrite material or other high-permeability material. The compact magnetic cable noise suppressor may be formed by molding a magnetic material to a desired shape followed by a high-temperature sintering operation.

The compact magnetic cable noise suppressor may be formed in multiple parts. For example, the compact magnetic cable noise suppressor may be formed from an upper half and a lower half or from three or more sections. These sections may have channels that define a curved cable path through the compact magnetic cable noise suppressor between an cable entrance and a cable exit. The curved cable path may contain one or more bends, loops, spirals, or other suitable curved path shapes. The curved nature of the cable path in the compact magnetic cable noise suppressor lengthens the path while allowing the dimensions of the noise suppressor to be minimized.

The cable entrance and cable exit may be vertically and laterally aligned or may located at different heights or lateral positions relative to one another. The compact magnetic cable noise suppressor may have multiple sides. The cable entrance and cable exit may be located on opposing sides of the compact magnetic cable noise suppressor or may be located on adjacent sides of the compact magnetic cable noise suppressor.

The compact magnetic cable noise suppressor may be housed in a cable connector or may be placed within a housing associated with a piece of electrical equipment. With one suitable arrangement, the compact magnetic cable noise suppressor may be formed from two rectangular slabs of ferrite. The curved cable path within the noise suppressor may be defined by channels that lie in a plane at which the two rectangular slabs are joined. The rectangular ferrite portions may be mounted within a metal cable connector between mating chassis portions.

Further features of the invention, its nature and various advantages will be more apparent from the accompanying drawings and the following detailed description of the preferred embodiments.

DETAILED DESCRIPTION

Figure 1:
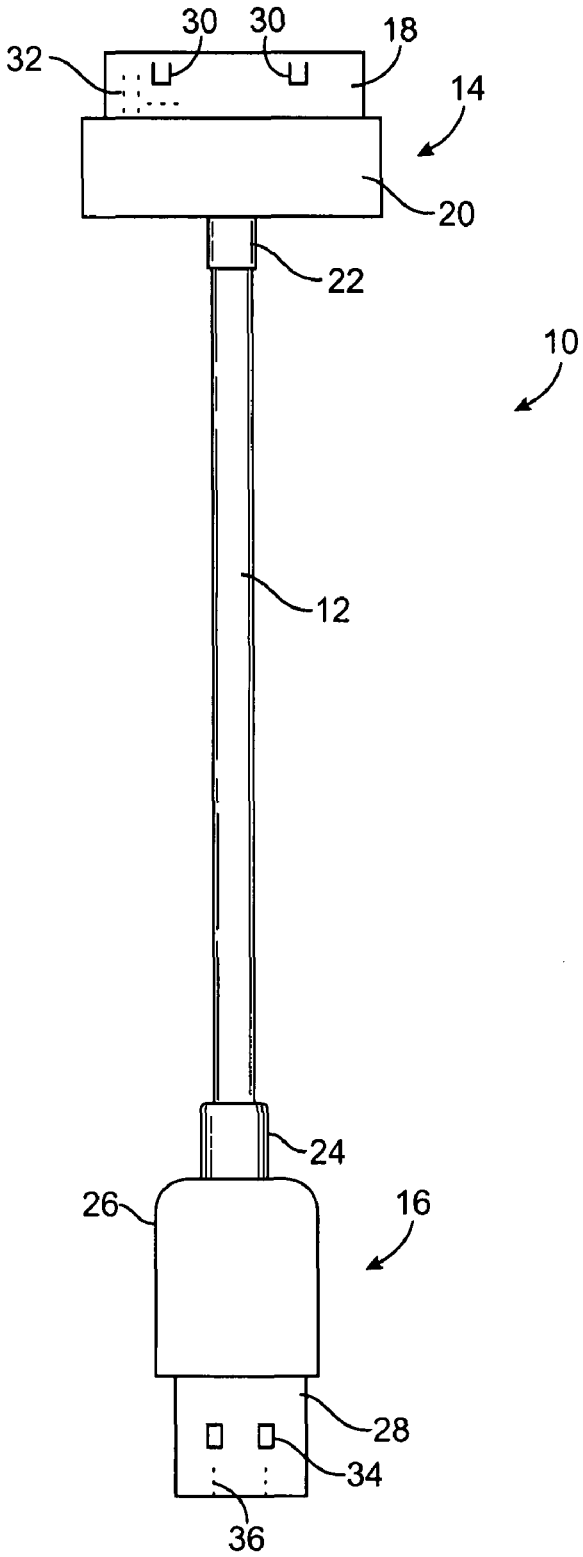
FIG. 1 is a top view of an illustrative cable with illustrative cable connectors that may use compact magnetic cable noise suppressors in accordance with an embodiment of the present invention.

Compact magnetic cable noise suppressors may be used to suppress electromagnetic noise on power and signal cables. An illustrative cable of the type that may use a compact magnetic cable noise suppressor in accordance with an embodiment of the present invention is shown in FIG. 1. Cable 10 may have connectors such as connectors 14 and 16 and a cable portion such as cable 12. A compact magnetic cable noise suppressor may be housed within connectors such as connectors 14 and 16. For example, a compact magnetic cable noise suppressor may be housed within connector 14.

Cable 12 may include any suitable conductive wires. A typical signal cable may include data wires and power wires. If desired, additional components (e.g., optical fiber) may be included in cable 12. Cable 12 may also be a power cord.

Connectors 14 and 16 may be formed using any suitable connector arrangements. With one suitable scheme, connectors 14 and 16 are of different types. For example, as shown in FIG. 1, cable connector 16 may be a universal serial bus (USB) connector and cable connector 14 may be a 30-pin cable connector. This is, however, merely illustrative. Connectors 14 and 16 may be the same (e.g., both may be USB connectors or both may be 30-pin connectors, etc.) or connectors 14 and 16 may be different.

Connectors 14 and 16 may plug into any suitable electronic equipment. For example, connector 16 may plug into a universal serial bus port on a personal computer and connector 14 may plug into a data port on a handheld electronic device that has music player and cellular telephone capabilities.

Connector 14 may have a main body 20 that has a plastic overmold. Connector 16 may have a main body 26 with a plastic overmold. Main body 20 of connector 14 and main body 26 of connector 16 may be formed from any suitable plastic or other dielectric. With one suitable arrangement, body 20 and body 26 are formed of polycarbonate. Strain relief elements 22 and 24, which may be formed from flexible plastic, may be used to help physically secure cable 12 to connectors 14 and 16. In a typical connector, metal pins or other suitable electrical contacts (herein collectively "pins") are used to convey signals from the wires within the cable to external equipment. In the example of FIG. 1, connector 14 is shown as having one or more pins 32 and connector 16 is shown as having one or more pins 36.

The number of pins within each connector should generally be equal to or greater than the number of conductive wires within cable 12. For example, if there are two power wires and two signal wires within cable 12, there should generally be at least four pins 36 and four pins 32 in connectors 16 and 14, respectively. If the number of pins on the connectors is insufficient, some wires may be terminated on common pins or some wires may be left unconnected.

If desired, there may be more pins on a particular connector than there are within cable 12. For example, there may be 30 pins 32 within connector 14, even in embodiments of cable 12 that use only four wires (as an example).

Plug portion 28 of connector 16 may have holes 34 that receive corresponding protruding portions on a mating female connector. This arrangement provides friction that helps to hold plug portion 28 to the female connector. Protruding portions 30 on metal plug portion 18 may be used to help secure metal plug portion 18 within a mating connector. Plug portions 28 and 18 may be shorted to ground.

With one suitable arrangement, cable 10 may be used in connection with equipment that handles upper megahertz-range and lower gigahertz-range cellular telephone signals and other such high-frequency data signals. Particularly in environments such as these, it can be advantageous to suppress electromagnetic noise. Failure to provide sufficient electromagnetic interference protection in cable 12 may cause high-frequency signals (including signal harmonics at frequencies equal to two times, three times, or even hundreds of times a base tone signal frequency) to be emitted by cable 12 into its surroundings. This emitted radiation may cause harmful interference with other equipment. Moreover, with insufficient electromagnetic interference protection, high-frequency signals from external sources may be coupled onto the cable and passed to equipment that is coupled to the cable.

To suppress electromagnetic interference of this type, at least one of the connectors of cable 12 such as connector 14 may be provided with a compact magnetic noise suppressor. In addition, cable 12 may be provided with conductive electromagnetic shielding (sometimes referred to as noise suppressing shielding).

Figure 2:
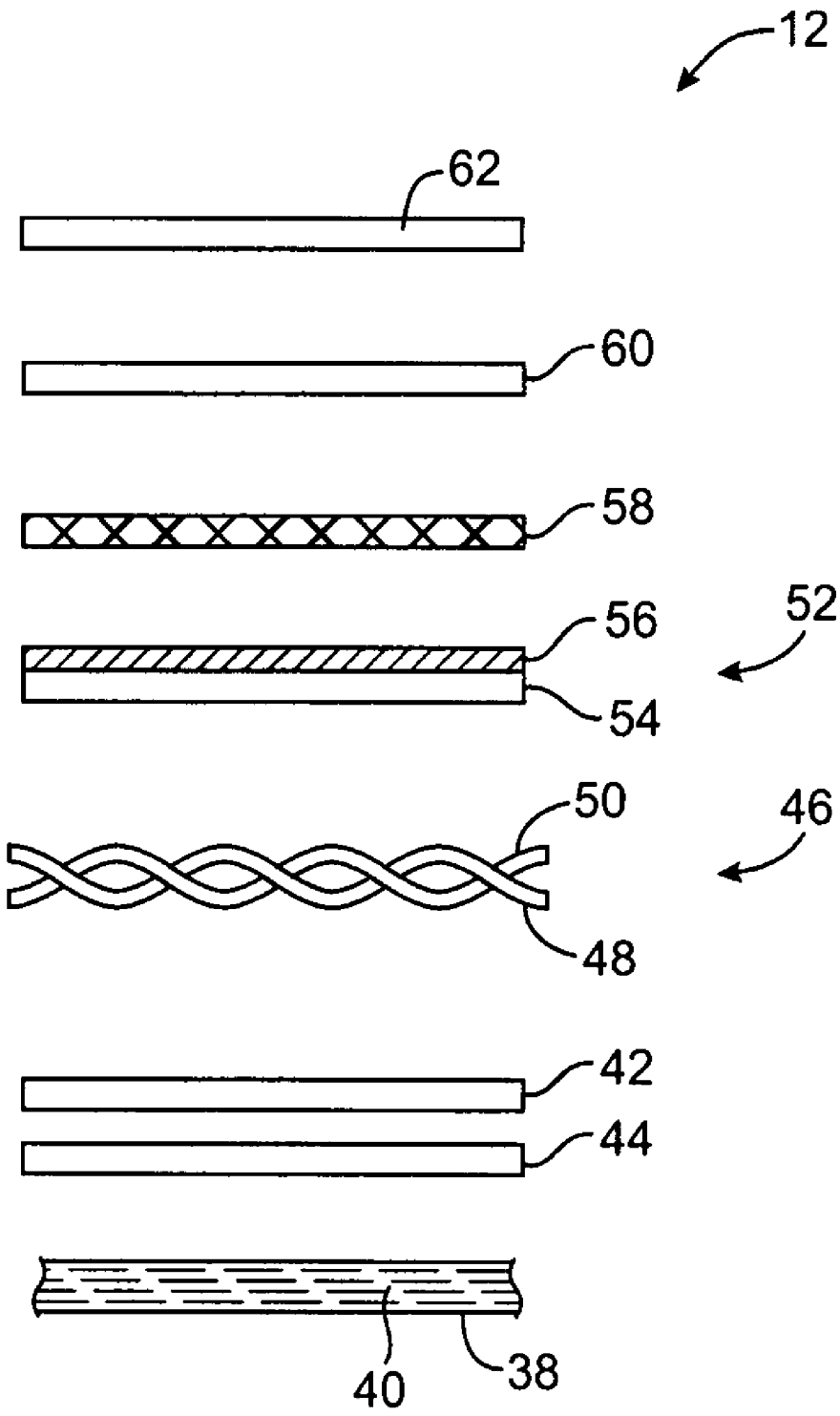
FIG. 2 is a schematic view of illustrative components of a cable that may be used with a connector containing a compact magnetic cable noise suppressor in accordance with an embodiment of the present invention.

Components that may be used to construct an illustrative cable are shown in FIG. 2. As shown in FIG. 2, strength may be provided to cable 12 using a structural component such as cord 38. Cord 38 may be formed from any suitable material, although non-conductive materials are generally desired to avoid interfering with the electrical operation of the data wires in cable 12. With one advantageous arrangement, cord 38 is formed from a high-strength synthetic material such as polyaramid polyparaphenylene terephthalamide (e.g., Kevlar®). Cord 38 may be made up of individual filaments 40 and may have any suitable density (e.g., 1000 denier).

Power wires such as power wires 42 and 44 may be used to carry alternating current (AC) or direct current (DC) power signals. Power wire 42 may be a ground wire and power wire 44 may be a positive power supply wire. If desired, there may be more power wires in cable 12. Power wires such as wires 42 and 44 may have any suitable diameters. With one suitable arrangement, power wires 42 and 44 may be formed of 26 gauge copper.

Signals wires 46 such as signal wire 48 and signal wire 50 may be used to carry data signals in cable 12. There may, in general, be any suitable number of signal wires in cable 12. With the illustrative embodiment of FIG. 2, cable 12 has two signal wires 48 and 50, which are provided in the form of a twisted pair to improve noise immunity. Signal wires such as wires 48 and 50 may have any suitable diameters. With one suitable arrangement, signal wires 48 and 50 may be formed of 26 gauge copper. When signal wires 48 and 50 are formed of 26 gauge wire and power wires 42 and 44 are formed of 28 gauge wire, the diameters of the conductive cores of signal wires 48 and 50 are smaller than the diameters of the conductive cores of power wires 42 and 44. This type of arrangement allows the power wires to carry more current than the data wires and provides more room for extra insulation on the data wires to improve data signal integrity.

Signal wires 46 and power wires 42 and 44 may be surrounded by conductive shields such as shield 52 and shield 58. Shield 52 may be formed of from a spiral wrap of conductive film having conductive layer 56 and backing layer 54. The conductive film may be provided in the form of a metallized plastic strip such as aluminized tape. The plastic backing material for the tape may be formed from a polyester film such as a biaxially-oriented polyethylene terephthalate polyester film (e.g., Mylar®). The layer of deposited aluminum on the tape helps to reduce electromagnetic interference for cable 12. If desired, conductor 56 may be deposited on both sides of backing 54 or may be deposited on the inner surface of backing 54.

Electromagnetic interference may be further suppressed using shield 58. Shield 58 may be, for example, a braided conductor. The braided conductor of shield 58 may be formed of copper or other suitable conductors. The braided conductor may have any suitable amount of coverage (e.g., more than 80%, more than 85%, more than 90%, more than 95%, 85-95%, etc.). If the coverage of the braided conductor in shield 58 is too high, cable 12 may become stiff. With one suitable arrangement, the braided conductor in shield 58 is copper braid of approximately 90% coverage. Braided conductor shield 58 and metal film conductive shield 52 may work together to reduce electromagnetic interference under a variety of bending conditions for cable 12. An advantage of depositing metal 56 on the outer surface of conductive shield tape 62 is that this provides a low impedance conducting path to conductive braid wires 60 of shield 58.

Cable 12 may have drain wire 60. Drain wire 60 may be a 28 gauge tinned copper wire that helps to electrically attach the metal plug portion 18 of connector 14 to braided shield 58.

Cable 12 may be housed within a plastic overmold formed of polyvinyl chloride plastic or other suitable insulating coating 62.

When cable 12 is plugged into electrical equipment, shields 52 and 58 and drain wire 60 may be shorted to ground. Ground noise that is present on shielding conductors can radiate as undesired electromagnetic signals unless properly suppressed. Additional noise suppression may therefore be provided in the form of a compact magnetic cable noise suppressor. The noise suppressor element may be housed in a connector such as connector 14 of FIG. 1. In power cables and other cables that do not have connectors such as connector 14, the compact magnetic cable noise suppressor may be attached to the cable without enclosing the compact magnetic cable noise suppressor within a connector housing. In cables that have connectors, however, it can be advantageous to place the compact magnetic cable noise suppressor within the connector housing, because this hides the compact magnetic cable noise suppressor from view and thereby helps improve the appearance of the cable.

Figure 3:
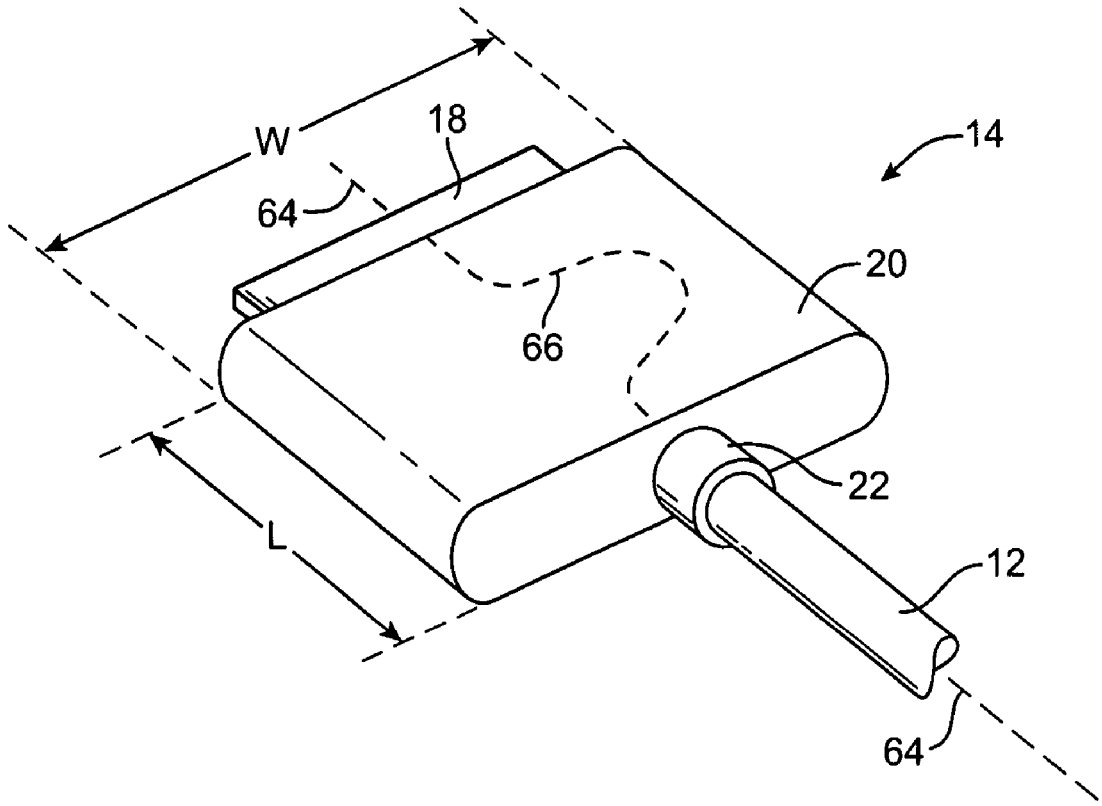
FIG. 3 is a perspective view of an illustrative cable connector that may contain a compact magnetic cable noise suppressor in accordance with an embodiment of the present invention.

An illustrative cable connector 14 is shown in FIG. 3. Main body 20 of connector 14, which is sometimes referred to as the housing of connector 14, may be formed from polycarbonate or other suitable materials. Strain relief element 22 may be used to help secure cable 12 to main body 20. Metal plug portion 18 may contain pins for conveying power and data signals. As shown in FIG. 3, connector 20 may be characterized by a longitudinal dimension L that is parallel to cable longitudinal axis 64 and a lateral dimension W that is perpendicular to cable longitudinal axis 64. Typical values for W and L are on the order of centimeters.

Conventional noise suppression elements are bulky, which can lead to unattractively large cable connectors. With a compact magnetic cable noise suppressor arrangement in accordance with an embodiment of the present invention, a noise suppressor structure is provided that is compact enough to allow dimensions such as L and/or W to be minimized without adversely affecting the efficacy of the noise suppressor in suppressing electromagnetic noise. In a typical arrangement, the noise suppressor contains a conduit that allows cable 12 to follow a curved path such as path 66 of FIG. 3. In the example of FIG. 3, this allows the dimension L to be reduced without reducing the effective length of the magnetic cable noise suppressor along cable 12. As a result, housing 20 can be made smaller for a given path length than would be possible if the cable followed a straight path through the noise suppressor.

Figure 4:
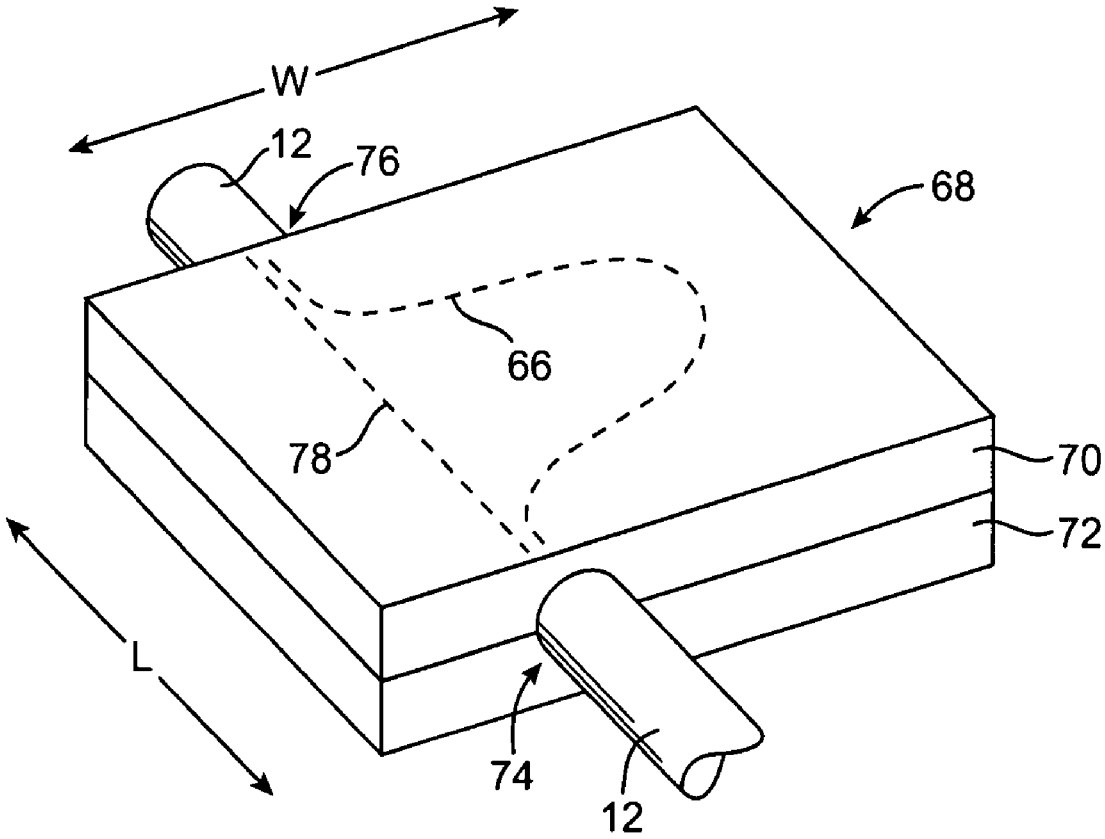
FIG. 4 is a perspective view of an illustrative two-piece compact magnetic cable noise suppressor attached to a cable in accordance with an embodiment of the present invention.

An illustrative compact magnetic cable noise suppressor 68 is shown in FIG. 4. As shown in FIG. 4, compact magnetic cable noise suppressor 68 may have cable entrance 74 and cable exit 76 through which cable 12 passes. As described in connection with FIG. 3, compact magnetic cable noise suppressor 68 may have a curved path 66 that extends the length of the cable that passes through the compact noise suppressor without making the compact magnetic cable noise suppressor unduly long in longitudinal dimension L. The length of path 66 within compact magnetic cable noise suppressor 68 may be about 10-15 mm or any other suitable length.

Compact magnetic cable noise suppressor 68 may be formed of a high permeability material suitable for suppressing electromagnetic noise. Compact magnetic cable noise suppressor 68 may, as an example, be formed from a ferrite material. Ferrites are generally formed from iron oxide mixed with other metal oxides or metal carbonates (e.g., oxides or carbonates of zinc, nickel, or manganese). The magnetic material of magnetic cable noise suppressor 68 may be provided as a powder and may be formed into a desired shape using a mold. In a typical fabrication process, the molded magnetic material is sintered at an elevated temperature. The sintering process hardens the magnetic material into the shape of the mold.

For satisfactory operation of compact magnetic cable noise suppressor 68, cable 12 preferably follows a path through the solid sintered material that makes up the compact magnetic cable noise suppressor that is longer than a straight path through the solid sintered material would be. For example, in the situation of FIG. 4, cable 12 follows a path (path 66) that has at least one bent or curved portion and that therefore has a length between cable entrance 74 and cable exit 76 that is greater than the length L of straight path 78 between cable entrance 74 and cable exit 76. With conventional noise suppressor arrangements, the maximum single-pass length through a noise suppression ferrite would be limited to L. In contrast, the compact magnetic cable noise suppressor arrangement of FIG. 4 allows the length of path 66 to be significantly longer than L. This maximizes the noise suppression capabilities of the compact magnetic cable noise suppressor without making the noise suppressor unnecessarily bulky.

Because the sintered noise suppression material that makes up noise suppressor 68 is generally hard, the compact magnetic cable noise suppressor 68 may be assembled from individual parts. When assembled, the noise suppressor contains a conduit along path 66 that may continuously surround cable 12 as cable 12 passes from cable entrance 74 to cable exit 76. In general, noise suppressor 68 may be formed from one unitary part, from two parts, from three parts, from four parts, from more than four parts, etc. In the example of FIG. 4, compact magnetic cable noise suppressor 68 is formed from two pieces: upper half 70 and lower half 72.

Figure 5:
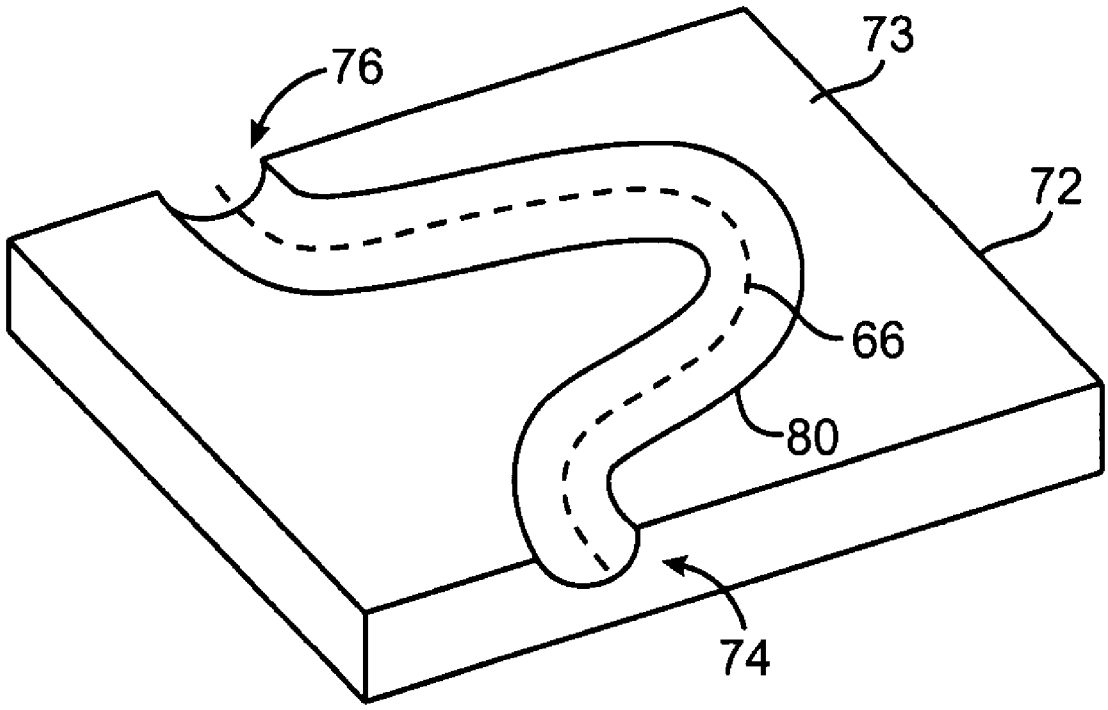
FIG. 5 is a perspective view of a lower half of the illustrative two-piece compact magnetic cable noise suppressor of FIG. 4 in accordance with an embodiment of the present invention.

Lower half portion 72 of compact magnetic cable noise suppressor 68 is shown in FIG. 5. As shown in FIG. 5, a lower portion of path 66 may be formed by channel 80 in lower half portion 72. Channel 80 may have a semicircular cross section. A corresponding channel may be formed in upper half portion 70 of compact magnetic cable noise suppressor 68 and may also have a semicircular cross section. When the upper and lower portions of compact magnetic cable noise suppressor 68 are joined together along the plane that includes upper surface 73 of lower half portion 72, the channels form path 66. In particular, the joined portions of compact magnetic cable noise suppressor 68 may form a conduit with a circular cross section through which cable 12 may pass.

The path 66 may have any suitable shape. Cables such as cable 12 are often round in cross section. In this type of situation, compact magnetic cable noise suppressor 68 may have a cable path with a matching circular cross section. The cross-sectional shape of the cable path may also be rectangular, square, triangular, polygonal, oval, or any other desired shape. Satisfactory noise suppression results may be obtained by constructing the path in compact magnetic cable noise suppressor 68 so that it is only slightly larger than cable 12. In this type of situation, the lateral dimensions of cable 12 (i.e. the diameter of a round cable) will match the lateral dimensions of path 66 (i.e., the diameter of a circular path) so that the cable path will continuously surround the cable as the cable passes between the cable entrance and the cable exit. There are generally no gaps between the outer surface of the cable and the inner surface of the compact magnetic cable noise suppressor cable path.

Figure 6:
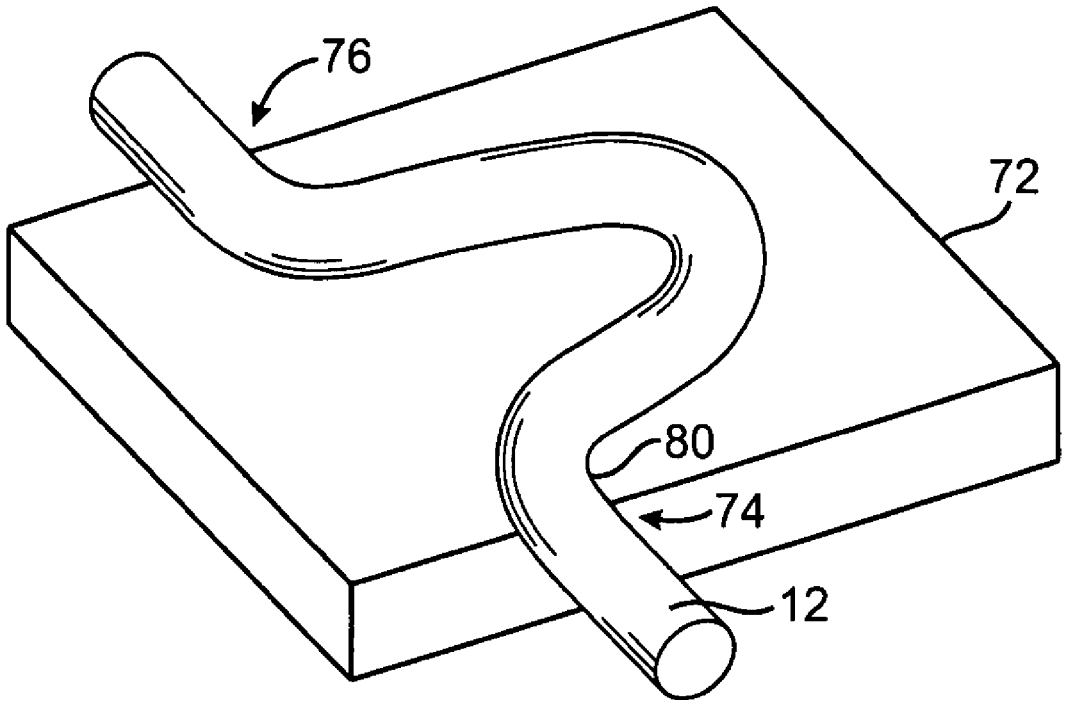
FIG. 6 is a perspective view showing how a cable may be mounted in the lower half of the magnetic cable noise suppressor of FIG. 5 in accordance with an embodiment of the present invention.

FIG. 6 shows how a round cable may be mounted in channel 80 of lower half portion 72 of compact magnetic cable noise suppressor 68. Mating upper half portion 70 of compact magnetic cable noise suppressor 68 may be placed on top of cable 12 to form compact magnetic cable noise suppressor 68 as shown in FIG. 4.

Portions of compact magnetic noise suppressor 68 such as portions 70 and 72 may be held together using any suitable technique. For example, portions such as portions 70 and 72 may be affixed to one another using adhesive, screws or other fasteners, etc. If desired, portions such as portions 70 and 72 may be secured using parts of a connector chassis.

Figure 7:
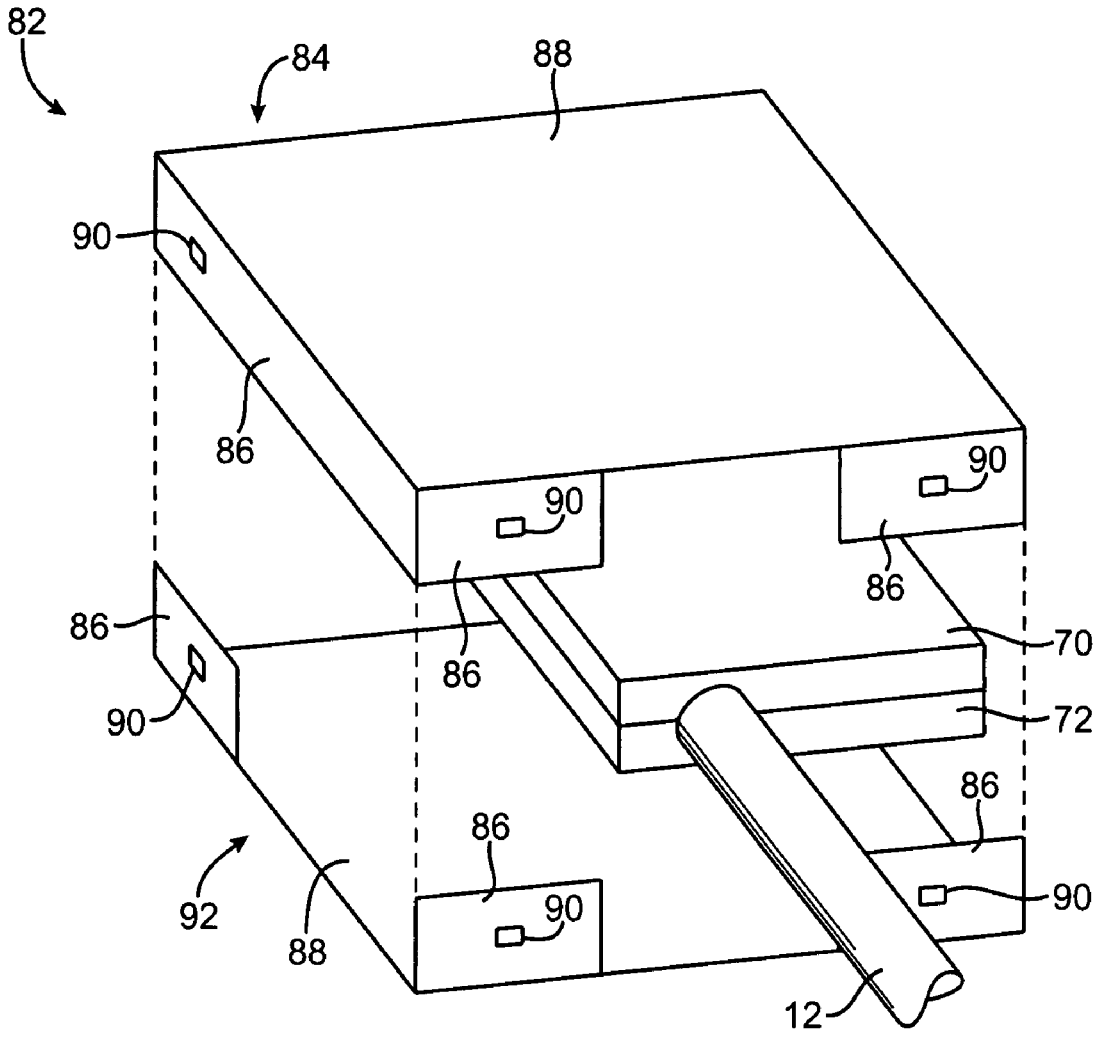
FIG. 7 is an exploded perspective view showing how two halves of a magnetic cable noise suppressor can be secured using a two-piece chassis in accordance with an embodiment of the present invention.

An illustrative connector chassis is shown in FIG. 7. Connector chassis 82 of FIG. 7 may form structural support for a connector such as connector 14 of FIG. 1. Chassis 82 may be formed from an upper chassis portion such as upper chassis portion 84 and a lower chassis portion such as lower chassis portion 92. Upper and lower chassis portions 84 and 92 may be formed from metal or any other suitable material. Chassis portions 84 and 92 may have sidewalls 86. Sidewalls 86 may be formed from bent metal tabs. Connectors 90 may be used to secure upper chassis portion 84 to lower chassis portion 92. In a typical arrangement, some of the connectors 90 may be holes and some of the connectors 90 may be matching tabs that fit into the holes and lock chassis portions 84 and 92 together during assembly.

Figure 8:
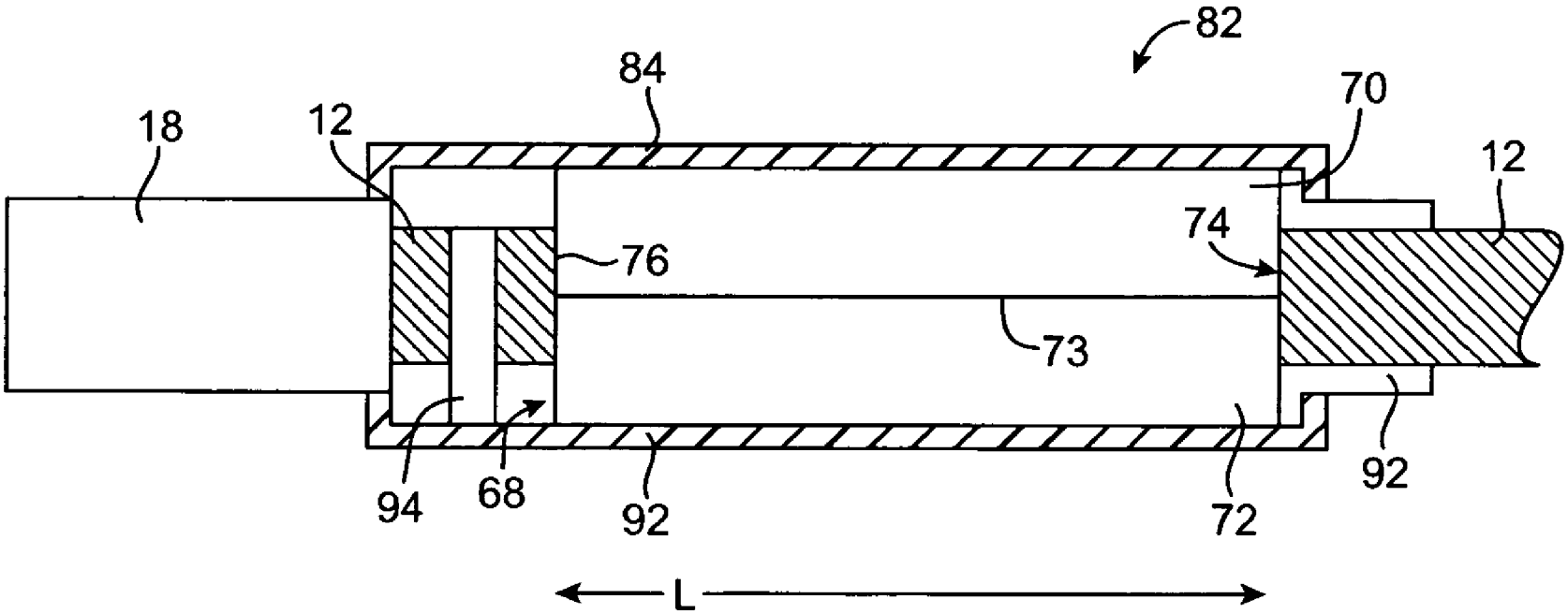
FIG. 8 is a cross-sectional side view of an illustrative compact magnetic cable noise suppressor of the type shown in FIG. 7 in which the pieces of the two-piece chassis have been joined to one another in accordance with an embodiment of the present invention.

A cross-sectional side view of an illustrative chassis 82 that has been formed by securing an upper chassis portion to a lower chassis portion is shown in FIG. 8. As shown in FIG. 8, once chassis portions 84 and 92 have been connected to each other, the assembled chassis secures upper portion 70 of compact magnetic cable noise suppressor 68 to lower portion 72 of compact magnetic cable noise suppressor 68 along plane 73. Support members such as support member 92 may be used to help secure cable 12 to chassis 82. Support member 92 may be formed from metal, plastic, or other suitable materials. If desired, cable 12 can be grounded to chassis 82 using a grounding connector such as connector 94. Connector 94 may be formed from a piece of bent metal that is welded or otherwise electrically and mechanically attached to chassis 82. Metal plug 18 may be connected to chassis 82 by capturing portions of plug 18 within mating chassis portions, using screws or other fasteners, with adhesive, using a combination of these techniques or any other suitable mounting technique.

After the cable, the compact magnetic noise suppressor, and other components such as plug 18 have been mounted within chassis 82, chassis 82 may be covered with a plastic overmold to form a completed connector such as connector 14 of FIG. 1. Because the cable path between cable entrance 74 and cable exit 76 is not straight, the cable path in the noise suppressor has an effective length that is larger than the longitudinal length L of the noise suppressor. This allows the size of connector 14 to be minimized while providing satisfactory noise suppression.

Figure 9:
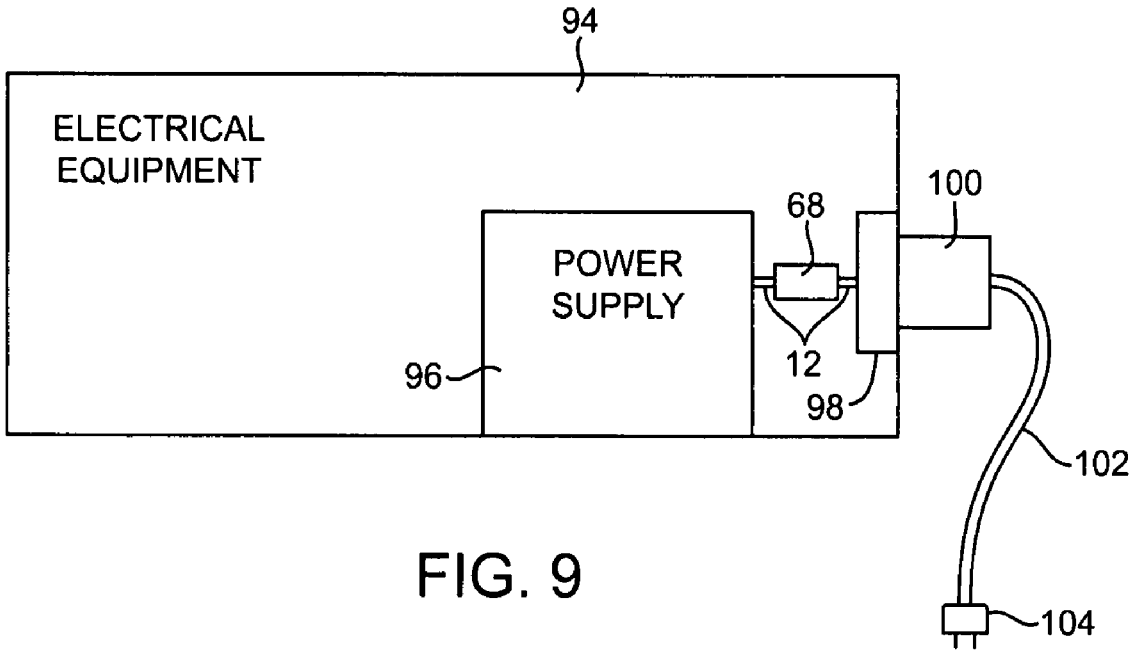
FIG. 9 is a cross-sectional side view of illustrative electronic equipment in which a compact magnetic cable noise suppressor is being used to suppress power supply noise on a power supply line in accordance with an embodiment of the present invention.

If desired, a compact magnetic cable noise suppressor may be used to suppress electromagnetic noise on a power cable. This type of arrangement is shown in FIG. 9. In the example of FIG. 9, electrical equipment 94 has a power supply 96. Power is provided to power supply 96 from a wall outlet using power plug 104, power cable 102, connector 100, connector 98, and interior power cable 12. As shown in this example, interior power cable 12 may be contained within the housing of electrical equipment 94. As a result, space may be at a premium. Particularly in environments such as these, it may be desirable to use a compact magnetic cable noise suppressor such as noise suppressor 68. As shown in FIG. 9, compact magnetic cable noise suppressor 68 may be placed on power cable 12 between connector 98 and power supply 96. Because compact magnetic cable noise suppressor 68 has compact dimensions, use of compact magnetic cable noise suppressor 68 in equipment 94 may make it possible to minimize the amount of space consumed by the noise suppressor in equipment 94, while at the same time avoiding the use of an unsightly external noise suppressor on cable 102.

Figure 10:
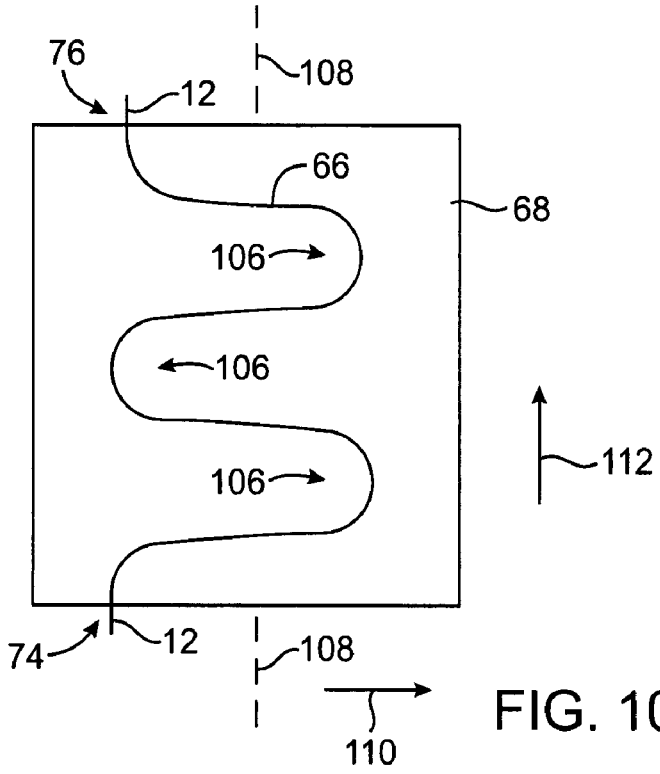
FIG. 10 is a top view of an illustrative compact magnetic cable noise suppressor showing how a cable may follow a path with multiple lateral bends in accordance with an embodiment of the present invention.

FIG. 10 is a top view of an illustrative compact magnetic cable noise suppressor showing how path 66 may have multiple bends 106. In the arrangement of FIG. 10, the bends in path 66 cause path 66 to meander back and forth along lateral dimension 110, while progressing from cable entrance 74 to cable exit 76 along longitudinal dimension 112, parallel to longitudinal axis 108 of compact magnetic cable noise suppressor 68.

Figure 11:
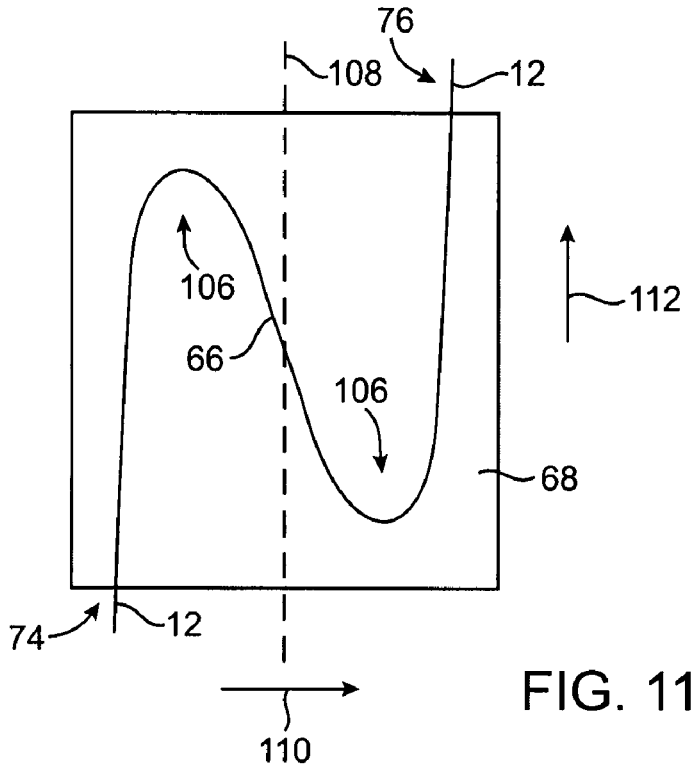
FIG. 11 is a top view of an illustrative compact magnetic cable noise suppressor showing how a cable may follow a path with multiple longitudinal bends in accordance with an embodiment of the present invention.

In the arrangement of FIG. 11, bends 106 cause path 66 to meander back and forth along longitudinal dimension 112 (parallel to longitudinal axis 108), while progressing laterally along dimension 110. Unlike the arrangement of FIG. 10, in which cable exit 76 and cable entrance 74 are laterally aligned, with the arrangement of FIG. 11, cable entrance 74 and cable exit 76 are laterally offset with respect to each other. In both the configuration of FIG. 10 and the configuration of FIG. 11, however, the cable exit and cable entrance are on opposing sides of the compact magnetic cable noise suppressor.

Figure 12:
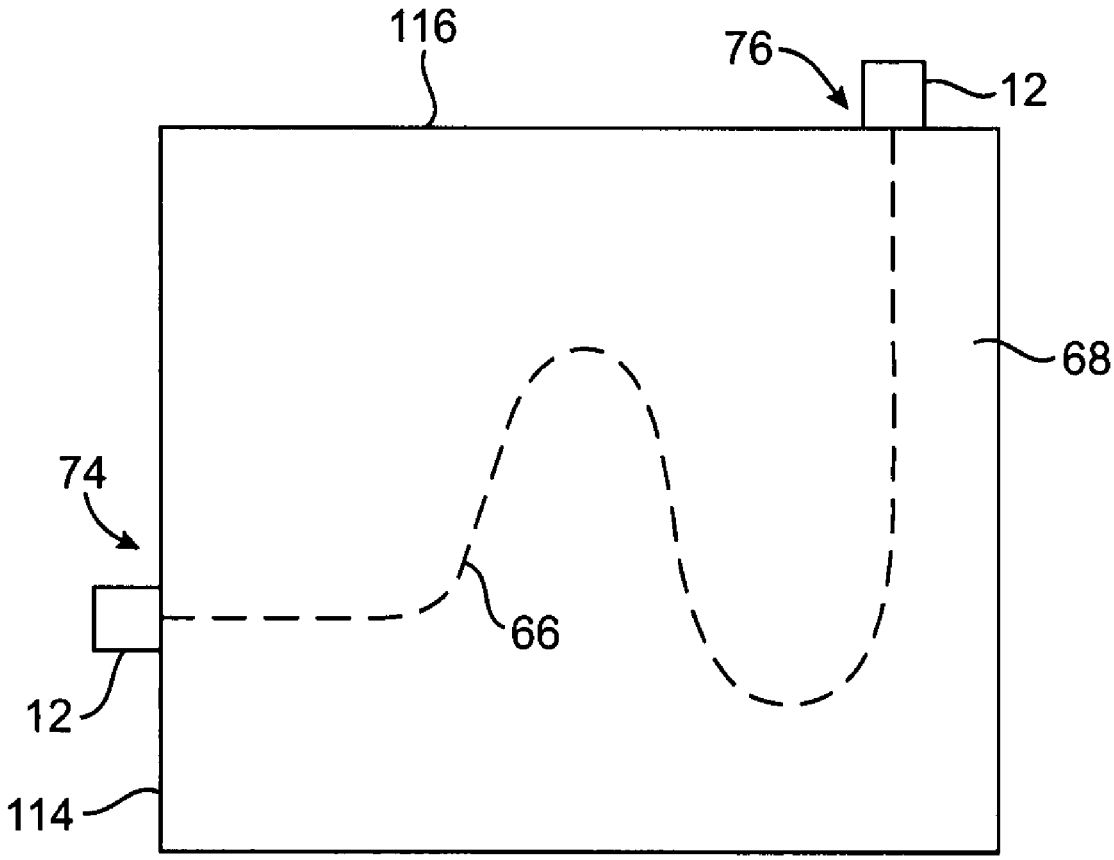
FIG. 12 is a top view of an illustrative compact magnetic cable noise suppressor showing how a cable may enter and exit sides of the compact magnetic cable noise suppressor that are not parallel to each other in accordance with an embodiment of the present invention.

If desired, cable path 66 may route the cable 12 through compact magnetic cable noise suppressor so that cable entrance 74 and cable exit 76 are not on opposing sides. This type of arrangement is shown in FIG. 12. As shown in FIG. 12, cable entrance 74 is formed on wall 114 of compact magnetic cable noise suppressor 68, whereas cable exit 76 is formed on adjacent wall 116 of compact magnetic cable noise suppressor 68. Unlike the arrangements of FIGS. 10 and 11 in which the cable entrances and cable exits were formed on opposing sides of compact magnetic cable noise suppressor 68, with the arrangement of FIG. 12, cable entrance 74 is formed in a wall that is perpendicular to the wall in which cable exit 76 is formed.

Figure 13:
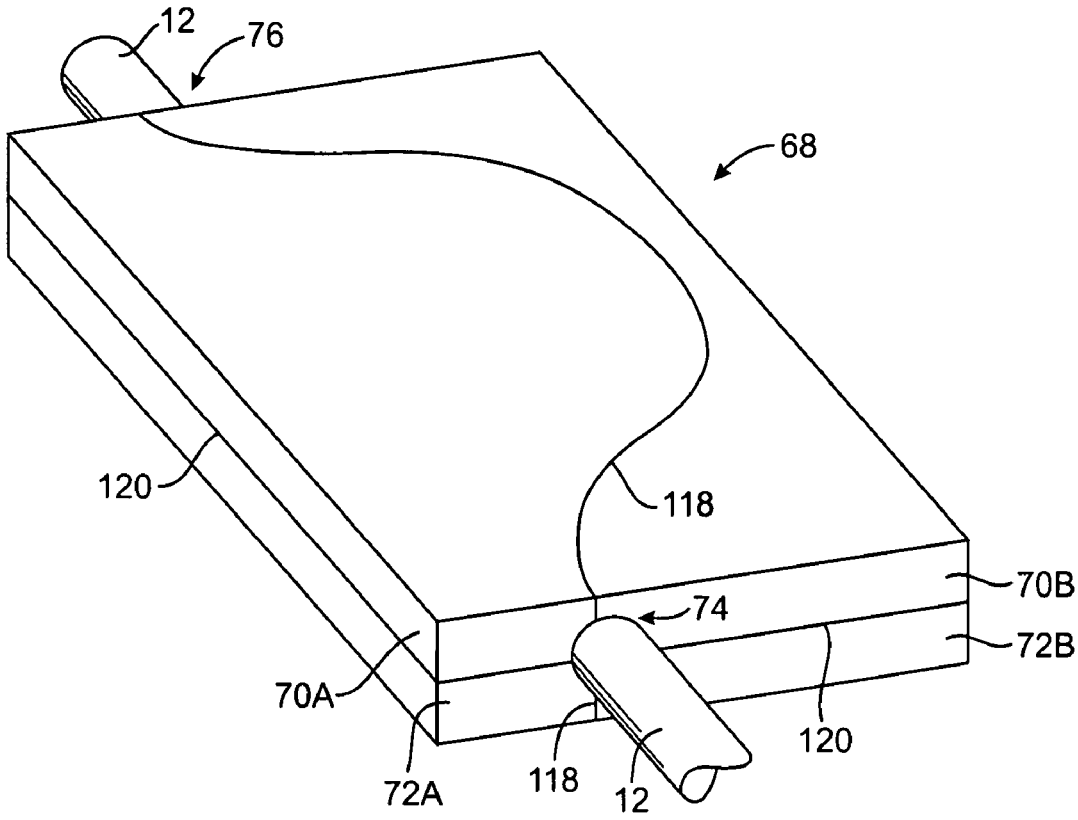
FIG. 13 is a perspective view of an illustrative compact magnetic cable noise suppressor formed from four parts in accordance with an embodiment of the present invention.

Compact magnetic cable noise suppressor 68 may be formed from any suitable number of individual pieces. In the example of FIG. 4, compact magnetic cable noise suppressor 68 was formed from upper portion 70 and lower portion 72. The upper and lower portions were joined at a plane that contains the cable path. An illustrative arrangement in which compact magnetic cable noise suppressor 68 has been formed from four pieces is shown in FIG. 13. As shown in FIG. 13, compact magnetic cable noise suppressor 68 has upper left portion 70A and upper right portion 70B. Compact magnetic cable noise suppressor 68 of FIG. 13 also has a lower left portion 72A and a low right portion 72B. Line 120 indicates the boundary between the upper portions and the lower portions of compact magnetic cable noise suppressor 68. Line 118 indicate the boundary between the left-hand portions and the right-hand portions of compact magnetic cable noise suppressor 68. Cable path 66 may follow the intersection of boundary 118 and boundary 120.

Figure 14:
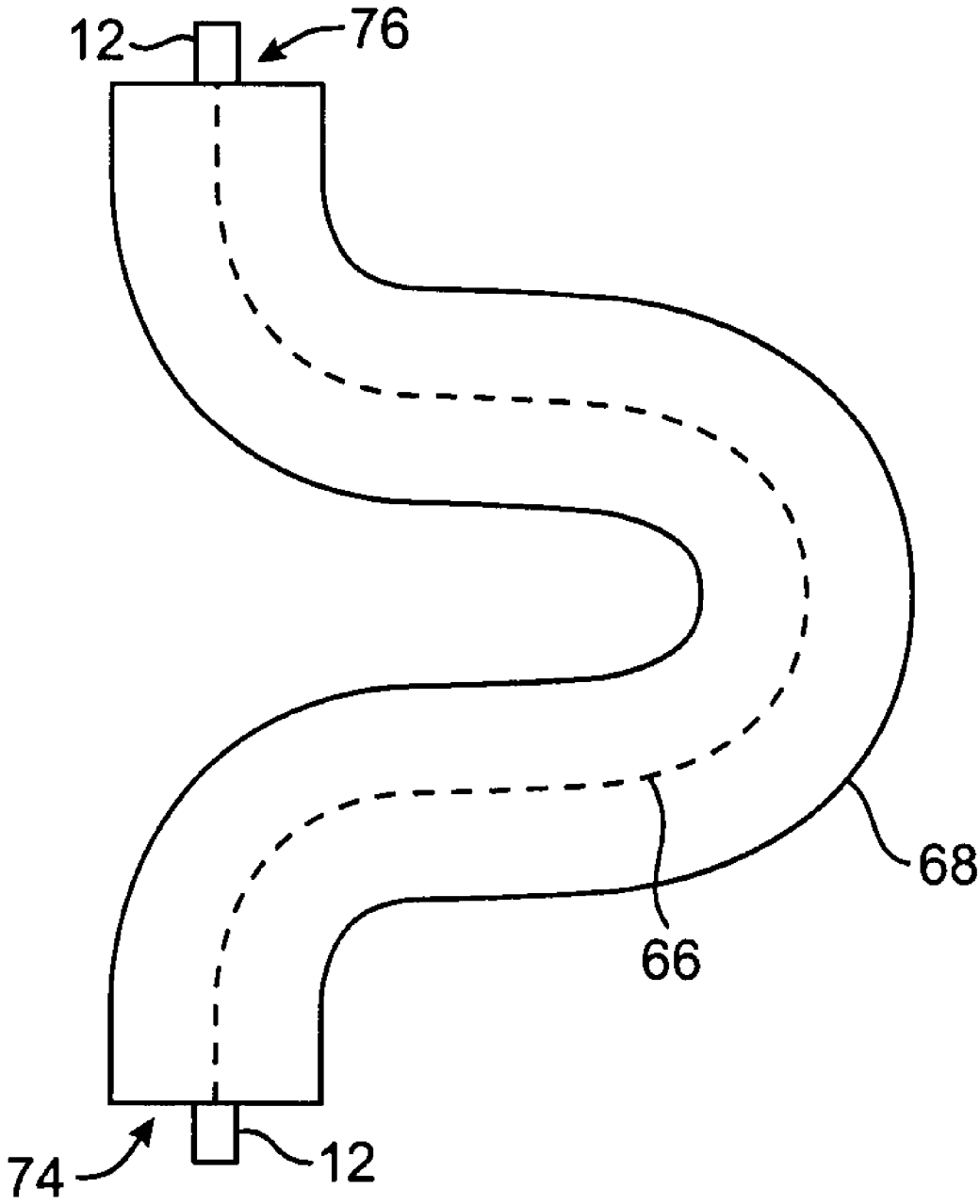
FIG. 14 is a top view of an illustrative compact magnetic cable noise suppressor that surrounds a cable and that has a curved shape that conforms to the curved path of the cable in accordance with an embodiment of the present invention.

As shown in FIG. 14, compact magnetic cable noise suppressor 68 need not be rectangular in shape. In the example of FIG. 14, compact magnetic cable noise suppressor 68 has been formed in a serpentine shape that follows a serpentine cable path 66 between cable entrance 74 and cable exit 76. An advantage of using a non-rectangular shape of the type shown in FIG. 14 is that it may conserve magnetic material and weight. Rectangular shapes may be advantageous in situations in which perpendicular sidewalls facilitate assembly.

Figure 15:
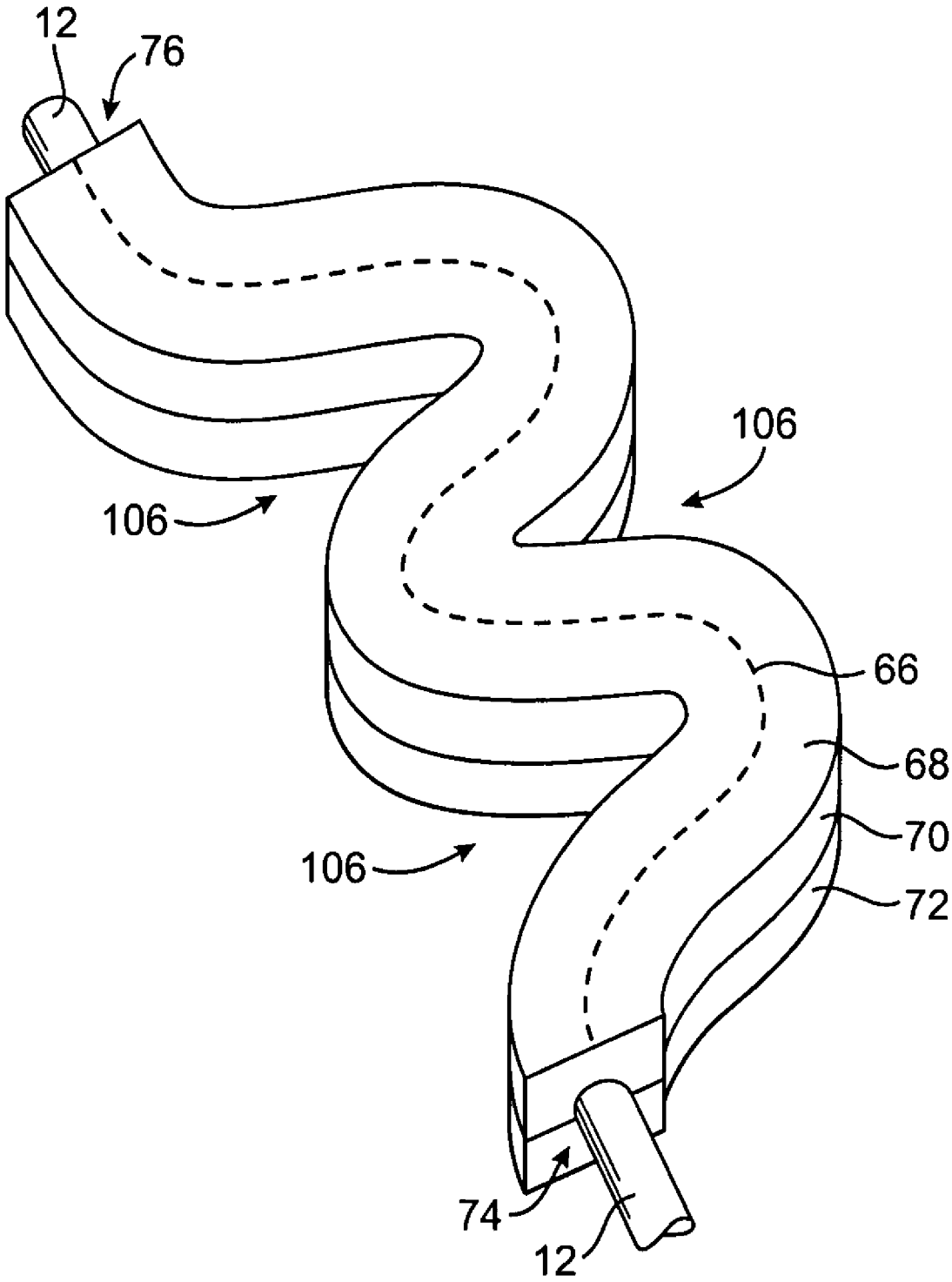
FIG. 15 is a perspective view of an illustrative compact magnetic cable noise suppressor that has a curved shape that follows a cable having a path with multiple bends in accordance with an embodiment of the present invention.

Another example of a compact magnetic cable noise suppressor that has a non-rectangular shape is shown in FIG. 15. In the configuration shown in FIG. 15, compact magnetic cable noise suppressor 68 has upper portion 70 and lower portion 72. There are three bends 106 in cable path 66 between cable entrance 74 and cable exit 76. To reduce weight and minimize the use of magnetic material, the shape of compact magnetic cable noise suppressor 68 of FIG. 15 conforms to path 66, as the shape of the compact magnetic cable noise suppressor 68 conforms to path 66 in FIG. 14.

Figure 16:
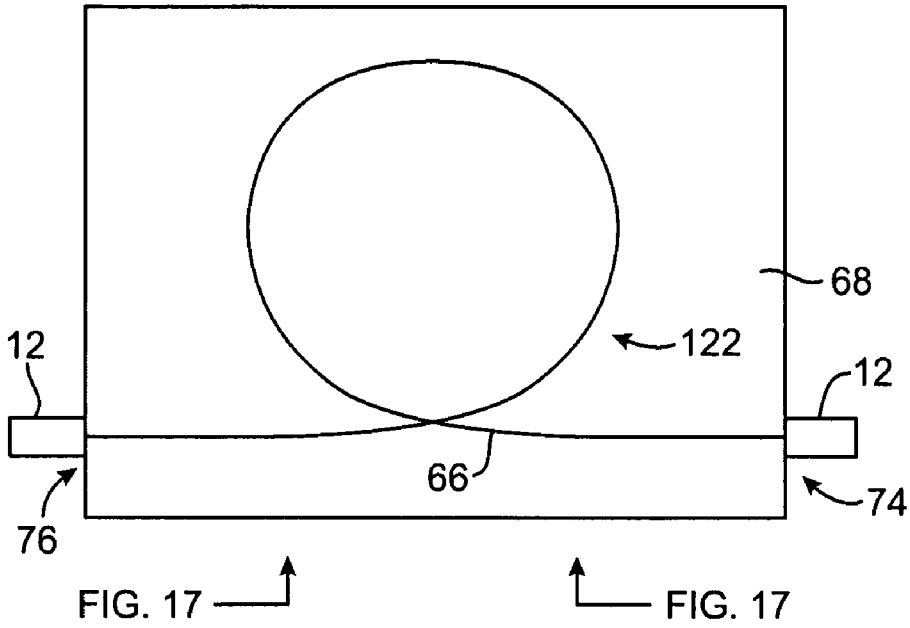
FIG. 16 is a top view of a compact magnetic cable noise suppressor that has a looped cable path in accordance with an embodiment of the present invention.

FIG. 16 is a top view of an illustrative embodiment of compact magnetic cable noise suppressor 68 in which path 66 contains a loop. There is only a single loop (loop 122) in the example of FIG. 16, although compact magnetic cable noise suppressor 68 may have any suitable number of loops (e.g., two or more loops, etc.).

Figure 17:
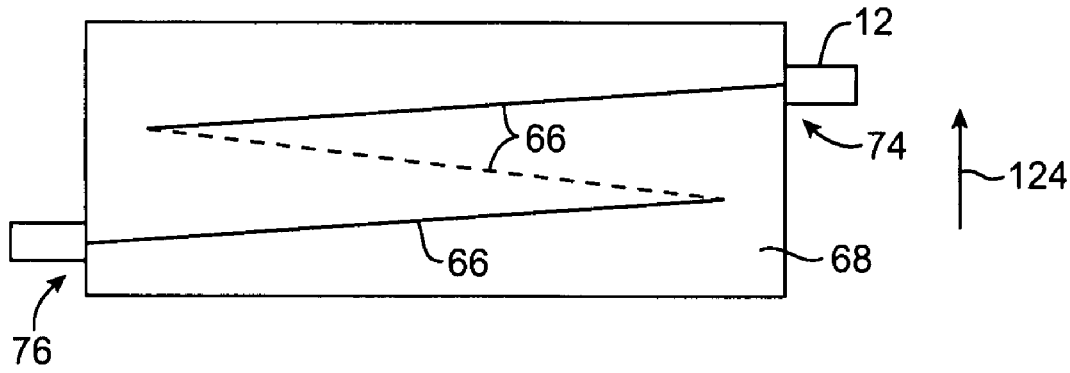
FIG. 17 is a side view of the compact magnetic cable noise suppressor of FIG. 16.

FIG. 17 is a side view of the illustrative compact magnetic cable noise suppressor 68 of FIG. 16. In FIG. 17, height may be measured along vertical dimension 124. As shown in FIG. 17, cable path 66 may have a height at cable entrance 74 that is different than its height at cable exit 76. Each layer of path 66 also has a different height. Cable entrance 74 and cable exit 76 are shown as being formed on opposite side walls of compact magnetic cable noise suppressor 68 in the example of FIG. 17. If desired, cable entrance 74 and cable exit 76 can be formed on side walls of compact magnetic cable noise suppressor 68 that are not opposite to each other and that are not parallel to each other.

Figure 18:
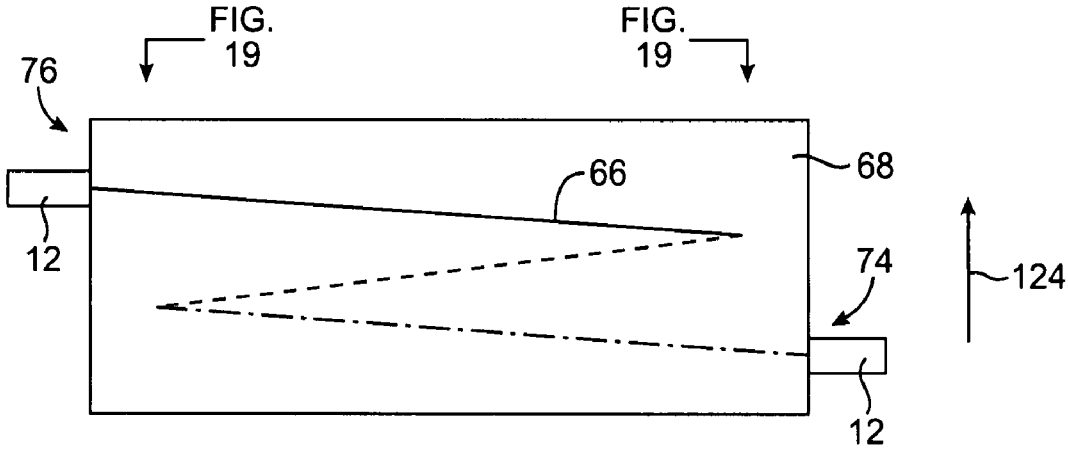
FIG. 18 is a side view of a compact magnetic cable noise suppressor having a three-layer cable path with lateral bends in accordance with an embodiment of the present invention.
Figure 19:
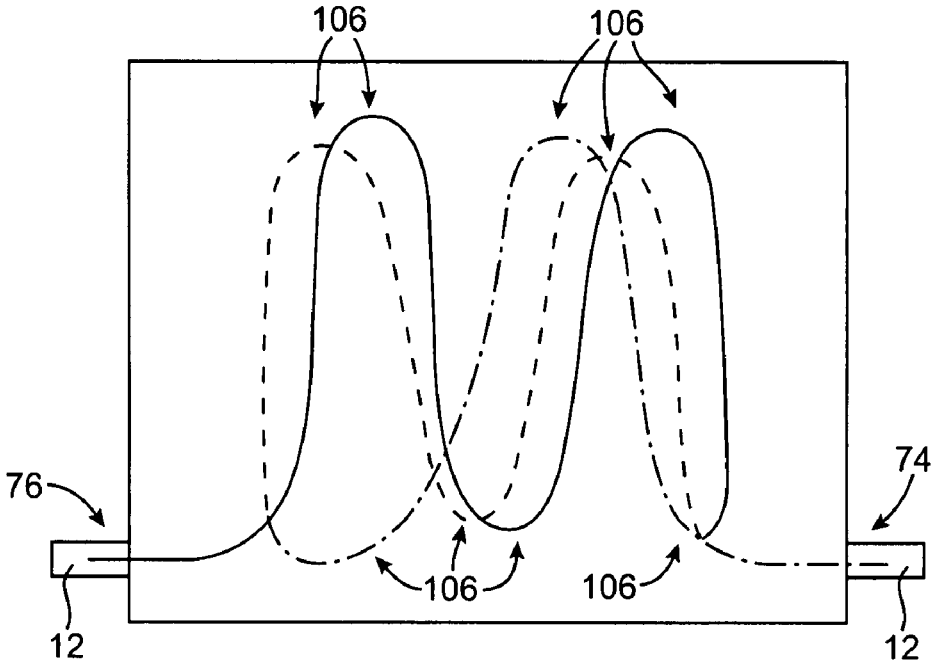
FIG. 19 is a top view of the compact magnetic cable noise suppressor of FIG. 18.

FIG. 18 is a side view of an illustrative compact magnetic cable noise suppressor 68 in which path 66 has multiple bends 106 and passes through different heights (positions relative to vertical dimension 124). FIG. 19 is a top view of the illustrative compact magnetic cable noise suppressor 68 of FIG. 18. In FIGS. 18 and 19, the solid line corresponds to the highest portion of path 66, the dashed-and-dotted line corresponds to the lowest portion of path 66, and the dashed line corresponds to a portion of path 66 that lies between the solid line portion and the dashed-and-dotted line portion.

Although the example of FIGS. 18 and 19 includes a three levels of cable path 66 each of which contains multiple bends 106, this is merely illustrative. Any suitable number of levels and bends may be used if desired.

Figure 20:
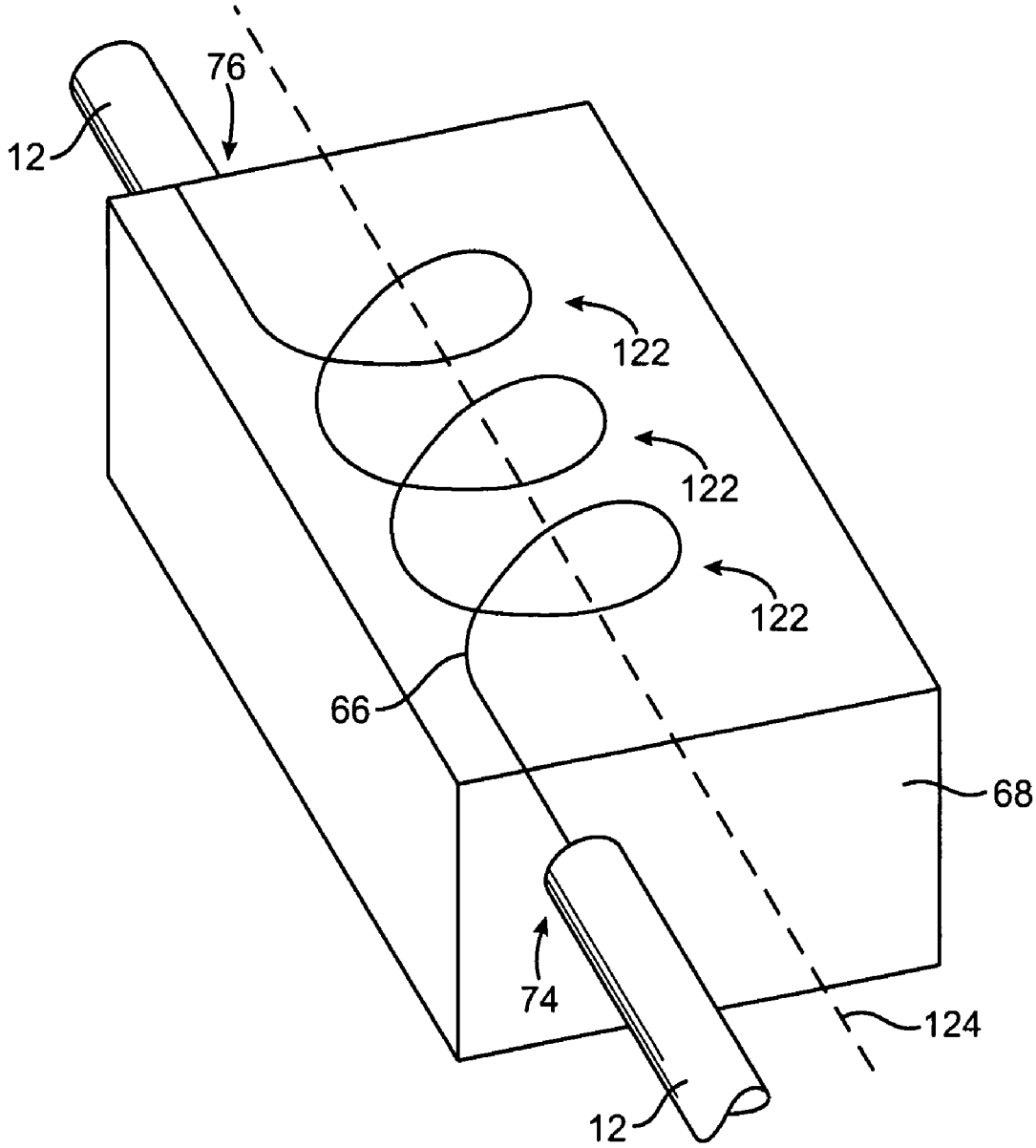
FIG. 20 is a perspective view of an illustrative compact magnetic cable noise suppressor having a spiral cable path in accordance with an embodiment of the present invention.

FIG. 20 shows an illustrative embodiment of a compact magnetic cable noise suppressor that has a spiral cable path. As shown in FIG. 20, path 66 may form three spiral loops 122 about longitudinal axis 124. There may be any suitable number of spiral loops 122 in compact magnetic cable noise suppressor (e.g., one spiral loop, two spiral loops, three spiral loops, more than three spiral loops, etc.). The example of FIG. 20 is merely illustrative.

In general, compact magnetic cable noise suppressor 68 may have any suitable number of levels in path 66, may have any suitable number of bends 106, may have a path that meanders laterally (as shown in FIG. 10) or longitudinally (as shown in FIG. 68), may have cable entrances and exits that are laterally aligned or are not laterally aligned, may have cable entrances and cable exists that are vertically aligned or that are not vertically aligned, may have cable entrances and exits on opposing sides or on adjacent sides, may have looped paths, may have other suitable arrangements for lengthening cable path 66 while minimizing the dimensions of suppressor 68, or may have combinations of such arrangements. The examples of FIGS. 3-20 are merely illustrative.

The foregoing is merely illustrative of the principles of this invention and various modifications can be made by those skilled in the art without departing from the scope and spirit of the invention.

What is claimed is:

1. A magnetic cable noise suppressor that suppresses electromagnetic noise in a cable that comprises a plurality of wires, comprising:

at least one portion defining a cable entrance;

at least one portion defining a cable exit; and at least one portion defining a cable path through the magnetic cable noise suppressor for the cable between the cable entrance and the cable exit, wherein at least part of the cable path is curved and wherein the cable path surrounds the cable and the plurality of wires as the cable passes between the cable entrance and the cable exit, wherein the magnetic cable noise suppressor has a vertical dimension and a lateral dimension that is perpendicular to the vertical dimension, wherein the portion defining the cable path comprises at least one portion defining a cable path with multiple levels along the vertical dimension, and wherein the cable entrance is aligned with the cable exit in the lateral dimension.

2. The magnetic cable noise suppressor defined in claim 1 wherein the portion defining the cable path comprise at least one portion defining at least one loop.

3. The magnetic cable noise suppressor defined in claim 1 wherein the portions comprise a first member and a second member that are joined to form the magnetic cable noise suppressor.

4. The magnetic cable noise suppressor defined in claim 1 wherein the portions comprise a ferrite material.

5. The magnetic cable noise suppressor defined in claim 1 wherein the portion defining the cable path comprises at least one portion defining a cable path having only a single bend between the cable entrance and the cable exit.

6. The magnetic cable noise suppressor defined in claim 1 wherein the portion defining the cable path comprise at least one portion defining a cable path having at least two bends between the cable entrance and the cable exit.

7. The magnetic cable noise suppressor defined in claim 1 wherein the cable exit and cable entrance are on opposing sides of the magnetic cable noise suppressor and wherein the cable path is longer than a straight path between the cable entrance and the cable exit.

8. The magnetic cable noise suppressor defined in claim 1 wherein the cable exit and cable entrance are on opposing sides of the magnetic cable noise suppressor and wherein the portion defining the cable path comprises at least one portion defining a spiral path through the magnetic noise suppressor.

9. The magnetic cable noise suppressor defined in claim 1 wherein the cable path has a circular cross-section.

10. Apparatus comprising:

at least one cable that contains wires; and a connector attached to at least one end of the cable, wherein the connector contains a magnetic cable noise suppressor that has a cable entrance, a cable exit, and a cable path through which the cable passes between the cable entrance and the cable exit, wherein the cable path surrounds the cable as the cable passes between the cable entrance and the cable exit, and wherein the cable path contains at least one bend, wherein the connector comprises a metal chassis having at least a first chassis and a second chassis portion, wherein the magnetic cable noise suppressor has a first half and a second half, wherein the cable path defines respective channels in the first half and the second half that form the cable path, wherein each of the channels comprises at least one bend, and wherein the magnetic cable noise suppressor is mounted in the metal chassis between the first chassis portion and the second chassis portion.

11. Apparatus comprising:

at least one cable that contains wires; and a connector attached to at least one end of the cable, wherein the connector contains a magnetic cable noise suppressor that has a cable entrance, a cable exit, and a cable path through which the cable passes between the cable entrance and the cable exit, wherein the cable path surrounds the cable as the cable passes between the cable entrance and the cable exit, and wherein the cable path contains at least one bend; and electronic equipment having a housing and having a power supply and a power connector disposed within the housing, wherein the cable is connected between the power supply and the power connector.

12. Apparatus comprising:

at least one cable that contains wires; and a connector attached to at least one end of the cable, wherein the connector is adapted to plug into a handheld electronic device, wherein the connector contains a magnetic cable noise suppressor that has a cable entrance, a cable exit, and a cable path through which the cable passes between the cable entrance and the cable exit, wherein the cable path continuously surrounds the cable as the cable passes between the cable entrance and the cable exit, and wherein the cable path contains at least one bend, wherein the cable path comprises at least two bends and wherein the noise suppressor has a shape that conforms to the bends.

13. The apparatus defined in claim 12 wherein the cable comprises at least one electromagnetic shield layer, wherein the noise suppressor comprises a ferrite having a first portion and a second portion that are joined along a surface that lies in a plane, and wherein the bend lies in the plane.

14. The apparatus defined in claim 12 wherein the path has a circular cross section, wherein the noise suppressor comprises sides and wherein the cable entrance and the cable exit are not on opposing sides of the noise suppressor.

* * * * *